United States Patent [19]

Lichtenstein

[11] Patent Number: 4,830,897

[45] Date of Patent: May 16, 1989

[54] MULTILAYER FABRIC CONTAINING ARCYLIC FIRE-RETARDANT FOAM

[76] Inventor: Cary Lichtenstein, 54 Oakvale, Highland Park, Ill. 60035

[21] Appl. No.: 83,530

[22] Filed: Aug. 7, 1987

[51] Int. Cl.[4] ..... B32B 3/02; B32B 3/26

[52] U.S. Cl. ..... 428/90; 427/206; 428/246; 428/284; 428/316.6; 428/920; 428/921

[58] Field of Search ..... 427/206; 428/90, 246, 428/284, 316.6, 920, 921

[56] References Cited

U.S. PATENT DOCUMENTS 4,056,646 11/1977 Westfall et al. ..... 428/90
4,353,945 10/1982 Sampson ..... 428/90
4,409,275 10/1983 Samowich ..... 428/90
4,418,106 11/1983 Landler et al. ..... 427/206

*Primary Examiner*—William J. Van Balen
*Attorney, Agent, or Firm*—Neuman, Williams, Anderson & Olson

[57] ABSTRACT

The invention consists of an improved method for making a fabric and the resulting fabric. The method provided includes the steps of applying a layer of acrylic foam to each surface of a thin cloth substrate. This acrylic foam may include fire retardant additives and additives which block light. The method further includes the step of embedding a thin layer of flock to the outer surfaces of the acrylic layers to impart a desired texture to them. The article provided includes a thin cloth substrate covered by at least one layer of acrylic on each of its sides and a thin layer of flock embedded in the outer surfaces of the acrylic layers.

1 Claim, 1 Drawing Sheet

MULTILAYER FABRIC CONTAINING ARCYLIC FIRE-RETARDANT FOAM

BACKGROUND OF THE INVENTION

1. Field of the Invention

The present invention generally relates to a process for making a fabric and the improved fabric which the process produces. More specifically, the present invention relates to a method of coating a cloth with acrylic to produce a low cost but esthetically pleasing fabric with superior fire-retardent and light-impeeding properties.

2. Description of the Prior Art

An increasing number of home and commercial applications for fabric require that it have certain desirable characteristics. These characteristics include, among others, surfaces which have a uniform texture and appearance and the ability to resist fire and block light. In addition, the fabric must have a construction which minimizes the expense of manufacture.

In the past, fabric producers used materials such as acrylic to impart the characteristics outlined in the previous paragraph to inexpensive cloth made with natural or synthetic fibers. One prior method for producing a composite fabric structure includes coating one side of a cloth web with one or more coats of acrylic foam which cures into a flexible layer. Typically, the arcylic foam contains black pigment which provides a barrier to light. It may also contain flame-retardant additives.

This prior method, however, covers one surface of a cloth substrate, leaving the opposite surface exposed. Accordingly, one surface appears and feels different from the other. If the producer uses an inexpensive substrate material, the resulting fabric includes a surface of inferior feel and appearance. Thus, the product cannot serve as a self-lined drapery or a free-hanging drapery lining. If the producer uses a high quality substrate material, the resulting fabric becomes cost prohibitive.

The present invention provides a process which applies at least one layer of acrylic foam or similar material to each side of a cloth substrate to completely cover the substrate and avoid the problems of the prior method. This method is simple and suitable for high production rates. It allows the manufacturer to use inexpensive, lightweight and loosely woven cloth for the substrate. Thus, it provides a substantial reduction in the cost of manufacture, and it produces a fabric capable of blocking light. This fabric is flame-retardant, and it has surfaces with a uniform texture and appearance.

SUMMARY OF THE INVENTION

Accordingly, it is a general object of the present invention to provide an improved process for placing or depositing at least one layer of a synthetic material with predetermined characteristics on each side of a cloth substrate.

It is a more specific object of this invention to provide a process which greatly reduces the cost of manufacture of fabrics.

It is another object of the present invention to provide a process which produces a fabric having the ability to resist fire and block light.

It is yet another object of this invention to provide a process which produces a fabric with surfaces which appear uniform and have a uniform texture.

It is a further object of the present invention to provide a inexpensive, flame-retardant fabric capable of blocking light and having surfaces which appear uniform and have a uniform texture.

Other objects and advantages of the invention will become apparent upon reading the following detailed description and appended claims and upon reference to the accompanying drawings.

The improved process of the present invention as well as the fabric which it produces achieve the foregoing objects and advantages. In the preferred embodiment, this improved process includes applying a first layer of acrylic foam to a first surface of a cloth substrate. This acrylic foam is a polymer which contains a foaming agent to facilitate coating. Preferably, the acrylic foam also contains fire retardant agents and black pigment to allow the first layer to serve as a barrier to light.

The cloth substrate is any suitable, inexpensive material made of natural or synthetic fibers. Conventional knife over roll coater machinery receives this cloth and applies a thin, uniform layer of acrylic to it. The acrylic flows into the spaces between the cloth fibers and hardens or cures, affixing itself to the cloth substrate. Preferably, the manufacturer applies the first layer by coating the substrate with two thin coats of acrylic foam containing dark pigment. Alternatively, the manufacturer may apply this first layer by coating the substrate only once with the same amount of acrylic foam required for the preferred two-coat procedure.

After the first layer of acrylic has cured, the maufacturer applies a second layer of acrylic over the first layer. This second layer provides the desired color to the fabric, covers the black layer and defines a smooth uniform outer surface for the fabric. The outer surface of this second layer remains exposed. Thus, to further improve the appearance and texture of this surface, the manufacturer, in accordance with the preferred embodiment of this invention, sifts a thin uniform layer of flock, cotton dust or fibers, to the surface before the second acrylic layer has hardened.

As a final preparation of this surface, the manufacturer may print a design on the surface, using a suitable ink. If the color desired for the fabric is black, the manufacturer may eliminate the second acrylic layer and apply the flock and the ink design directly onto the first layer.

The next step in the preferred embodiment comprises applying a third layer of the acrylic foam to the other side of the substrate to impart the desired color to this other side and to define a uniform surface for the second side of the fabric. To further prepare this surface, a maker of the fabric applies a layer of flock to the third acrylic layer and may print a design on it.

The preferred embodiment of the fabric that the process of the present invention produces includes a cloth substrate made of inexpensive natural or synthetic fibers. A first and second layer of acrylic covers a first side of the cloth substrate. The first layer has flame-retardant and black pigment additives; and it provides a barrier to light. The second layer covers the first and includes a white or color pigment as well as a flame-retardant. It provides coloration for the fabric and a uniform outer surface. A layer of flock embedded in the second acrylic layer provides a desirable appearance and texture and a suitable surface for printing a pattern with ink or other suitable material.

A third acrylic layer covers the second or opposite surface of the substrate cloth and together with the other acrylic layers completely covers the substrate. This third layer provides color to the second surface of the substrate and a uniform surface of the fabric. A layer of flock applied to this surface improves its appearance and texture. A printed design may further improve this surface.

BRIEF DESCRIPTION OF THE DRAWINGS

For a more complete understanding of this invention, one should now refer to the embodiment illustrated in greater detail in the accompanying drawings and described below by way of an example of the invention. In the drawings:

While the following description discloses the invention in connection with a preferred embodiment, one should understand that the invention is not limited to this embodiment. Furthermore, one should understand that the drawings are not necessarily to scale. Specifically, FIG. 2 shows a fabric produced by the process of the present invention which consists of overlapping layers of various materials. The thicknesses of the layers represented are not necessarily drawn to scale. These figures do not show the relative thickness of these levels. They merely facilitate an understanding of the relative position of each component of the fabric.

DETAILED DESCRIPTION OF THE DRAWINGS AND THE PREFERRED EMBODIMENT

Figure 1:
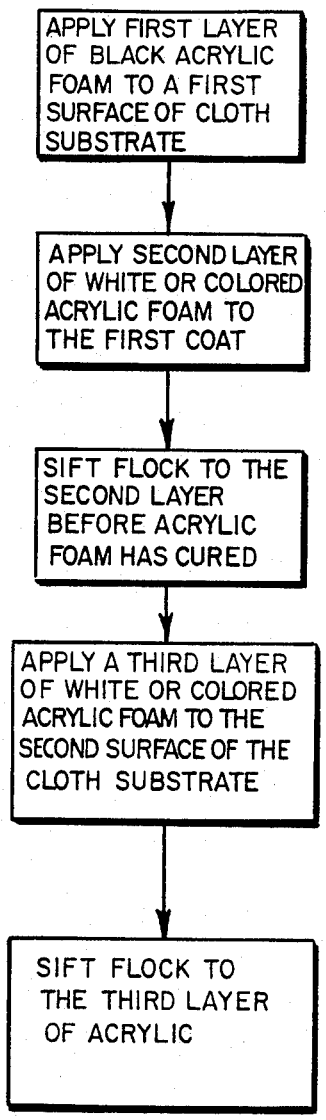
FIG. 1 is a flow diagram of the process of fabricating an improved fabric in accordance with the preferred embodiment of the present invention.
Figure 2:
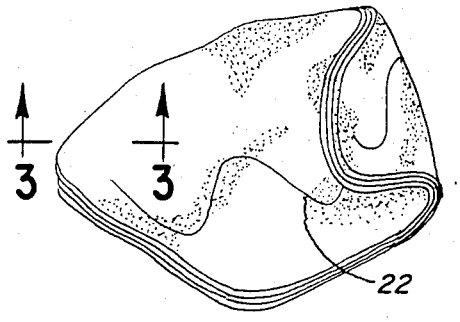
FIG. 2 is a perspective view of a piece of the fabric of the present invention.

The flow diagram shown in FIG. 1 illustrates the process of the present invention which produces the improved fabric 11. As shown, the process includes applying a first layer of acrylic foam 13 to a first surface 15 of a thin web of cloth 17. The manner in which a maker of the fabric applied the acrylic foam to the fabric is well known in the field and does not form a part of the present invention. This cloth 17 is any suitable, inexpensive material made of natural or synthetic fibers. Preferably, it is a woven material in a "grey" or untreated condition.

The acrylic foam is a polymer containing a foaming agent to facilitate coating. For example, a suitable acrylic foam is Hipofoam FR10 manufactured by Highpoint Chemical Corp., High Point, N.C. In the preferred embodiment, the acrylic foam includes a fire retardant compound, e.g., titanium oxide, to improve the fire resistant characteristics of the resulting fabric 11. The acrylic foam used to form the first acrylic layer 13, also contains a dark pigment, preferably a black pigment, which prevents light from passing through the layer. Thus, the first layer 13 serves as a light barrier.

To apply the acrylic foam to the cloth substrate 17, the one practicing the present invention uses conventional knife over roll coater machinery or other suitable devices. This machinery operates at an average speed of approximately 20–40 yards per minute and applies a thin, uniform coat of acrylic to the substrate. As the machinery applies the acrylic to the cloth, the acrylic flows into the spaces between the cloth fibers and hardens or cures, affixing itself to the cloth 17. (For the sake of clarity the drawings do not illustrate this phenomenon of saturating between the cloth fibers. Instead they show the various layers as being separate, but one should understand that the foregoing structure actually occurs). Preferably, the maufacturer applies the first layer 13 by coating the substrate 17 with two thin coats of acrylic foam containing dark pigment. Alternatively, the manufacturer may apply this first layer by coating the substrate 17 only once with the same amount of acrylic foam required for the preferred two-coat procedure.

After the first layer of acrylic foam 13 has cured, the manufacturer applies, in the manner described in the text above, a second layer of white or colored acrylic foam 19 to cover the first layer of acrylic 13. This second layer 19 provides the desired color to the first side of the fabric 11 and covers the entire first black layer 13.

To further prepare the first side of the substrate 17, the process includes sifting a thin uniform layer of flock 21, cotton dust or fibers, to the second layer of acrylic 19 before it cures. The flock embeds itself into the surface of the acrylic and sticks to the acrylic. Here, it provides a smooth texture and a uniform appearance to the acrylic finish.

As a final preparation for the first side of the fabric 11, the manufacturer may print a design with a suitable ink to the surface which includes the layer of flock 21. If the color desired for this side of the fabric is black, the manufacturer may eliminate the second acrylic layer 19 and apply the flock and the ink design directly onto the first black layer 13.

After preparing one side of the cloth substrate, the maker of the fabric applies a third layer of acrylic foam 23 to the opposite or second surface of the cloth substrate 17. Since the substrate 17 has already received a layer which serves as a barrier to light (the first acrylic layer 13), this third acrylic layer 23 may be any desirable color, including white or black. The layer 23 also has the fire retardant additives included.

Before the third acrylic layer has cured, the manufacturer sifts a layer of flock 25 to the layer 23 to impart the desired texture and uniform appearance to the second side of the fabric 11. After the third layer has cured the manufacturer may print a design with a suitable ink on the surface which supports the flock layer 25.

Thus, acrylic completely covers the cloth 17 and any imperfections which the cloth 17 may have. This allows the use of any inexpensive, lightweight, open weave cloth for a substrate, resulting in a substantial reduction in cost of constructing the fabric 11. In addition to reducing the cost of manufacture, the method of the present invention also produces an fabric which can block light, is completely fire-retardant and has an improved texture and appearance.

Figure 3:
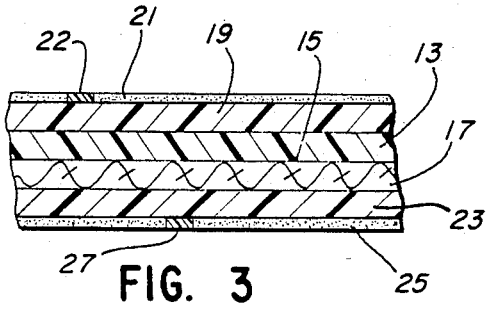
FIG. 3 is a perspective view taken along line 3—3 in FIG. 2.

The fabric 11 which the process of the present invention produces appears in FIG. 3. As shown, the fabric 11 includes a cloth substrate 17 with a first black acrylic layer 13 applied to the first surface of the substrate. This layer 13 serves as a barrier to light and covers the first surface of the cloth substrate. A second acrylic layer 19 covers the first black layer, imparts the desired coloration for the fabric, and defines a smooth and uniform outer surface for the fabric.

A layer of flock 21 embedded in the outer surface of the second acrylic layer 19 provides a smooth texture and pleasant feel to the finished fabric 11. In addition to the flock layer 21, the fabric may also include a printed ink design 22 applied to the outer surface of the secndd layer to further improve the appearance of the fabric.

A third acrylic layer 23 covers the opposite or second surface of the cloth substrate and defines a second smooth and uniform outer surface for the fabric 11. This layer 23 has a predetermined color; or it may be white or black. Together with the layers 13 and 19, it covers the cloth substrate 17 to conceal any imperfections in the cloth and allow the use of inexpensive substrates. To improve the appearance and feel of the exposed surface of the third layer 23, the fabric includes a second layer of flock 25 and, if desired, a printed design 27.

Thus, the above disclosure has provided an improved method for fabricating an improved fabric at a substantial reduction in cost. This method allows the manufacturer to use inexpensive, lightweight and loosely woven cloth for a substrate. It produces a fabric capable of blocking light and resisting fire and having surfaces which have a uniform texture and improved appearance.

While the application has shown only one embodiment of the invention, one will understand, of course, that the invention is not limited to this embodiment since those skilled in the art to which the invention pertains may make modifications and other embodiments of the principles of this invention particularly upon considering the foregoing teachings. The present invention discloses a method for producing an improved fabric and includes the steps of applying at least one acrylic layer to opposite sides of an inexpensive cloth substrate. These acrylic layers may include additives which impart desirable properties to the fabric, e.g., the ability to block light and resist fire. The applicant, therefore, by the appended claims, intends to cover any such modifications and other embodiments as incorporate those features which constitute the essential features of this invention.

What is claimed is:

1. A multilayer fabric comprising: a substrate of cloth having an obverse and reverse surface; a first acrylic fire-retardent foam layer having an opaque pigment, adhered to said substrate, and covering said obverse surface of said substrate to provide a light barrier for said fabric and a smooth uniform first surface; a supplemental acrylic fire-retardant foam layer adhered to said first acrylic foam layer; a flock layer adhered to said supplemental acrylic foam layer to provide a first textured surface for said fabric; an inked design layer adhered to a portion of said first textured surface to provide a first finished surface for said fabric; a second acrylic fire-retardant foam layer adhered to said substrate and covering said reverse surface of said substrate to provide a smooth, uniform second surface for said fabric; a second flocked layer adhered to said second acrylic foam layer to provide a second textured surface for said fabric; and, a second inked design layer adhered to a portion of said second textured surface to provide a second finished surface to said fabric.

* * * * *